United States Patent [19]

Peters et al.

[11] Patent Number: 4,641,385

[45] Date of Patent: Feb. 10, 1987

[54] ARMBOARD RAIL

[75] Inventors: Gerald Peters, Elyria; Eugene P. Hayton, Medina; Raymond A. Failor, Seville, all of Ohio

[73] Assignee: Simmons Universal Corporation, New York, N.Y.

[21] Appl. No.: 759,987

[22] Filed: Jul. 29, 1985

[51] Int. Cl.[4] ..... A61G 1/00

[52] U.S. Cl. ..... 5/82 R; 5/430

[58] Field of Search ..... 5/81 R, 81 B, 81 C, 5/82 R, 82 B, 83–89, 122, 157, 193, 202, 424, 425, 427–430; 128/103, 108, 139; 269/47, 50, 254 CS, 328

[56] References Cited

U.S. PATENT DOCUMENTS

| | | | |
|---|---|---|---|
| 2,048,955 | 7/1936 | Showalter | 5/427 |
| 2,891,258 | 6/1959 | Reichert | 5/428 |
| 3,045,259 | 7/1962 | Mayer | 5/429 |
| 3,220,023 | 11/1965 | Dewey | 5/428 |
| 3,742,527 | 7/1973 | Johnston et al. | 5/63 |
| 3,823,428 | 7/1974 | Whyte | 5/429 |
| 3,997,792 | 12/1976 | Conrad et al. | 5/425 |
| 4,332,042 | 6/1982 | Koncelik | 5/424 |
| 4,439,880 | 4/1984 | Koncelik et al. | 5/429 |

FOREIGN PATENT DOCUMENTS

| | | | |
|---|---|---|---|
| 691 | of 1890 | United Kingdom | 5/430 |
| 1006956 | 10/1965 | United Kingdom | 5/425 |
| 1006957 | 10/1965 | United Kingdom | 5/430 |

*Primary Examiner*—John E. Murtagh
*Assistant Examiner*—Andrew Joseph Rudy
*Attorney, Agent, or Firm*—A. Thomas Kammer

[57] ABSTRACT

A rail assembly for a wheeled stretcher or the like is provided. The assembly is pivotably mounted to the stretcher and may be locked in up, down or horizontal positions. Unlocking is accomplished by pushing a locking tab while moving the assembly towards the foot end of the stretcher.

5 Claims, 4 Drawing Figures

ARMBOARD RAIL

BACKGROUND OF THE INVENTION

1. Field of the Invention

The field of the invention relates to rails for protecting a person from rolling off a stretcher or bed.

2. Brief Description of the Prior Art

Wheeled stretchers and the like are usually equipped with protective armboard rails on both sides thereof. Existing hinge side rail devices operate by using a slide tube type action. The side rail has two hollow tubes attached at each bottom end. Notches are provided on the outer edges thereof. The entire rail assembly slides back and forth over the main side tubes of the stretcher top. To enable the side rails to index to various positions around the main side tubes, a fixed pin fits into the notches on the end of the rail. The associated rail's hollow tube (with notches) is forced against the pin at the desired notch to provide an appropriate rail location. The forcing action is caused by a spring located on the main side tube between a fixed point and the hollow tube of the hinging rail. Changing the position of the rail involves relieving the load from the spring, horizontally sliding the rail, indexing the rail to the desired location, and, releasing the rail to spring back into one of the notches. The side rail is locked in any position by a separate removable locking pin. If this pin is not inserted after positioning, the patient or attendant can push or pull the rail horizontally and change rail position unintentionally.

Disadvantages involved in the use of a removable locking pin include the possibilities of misalignment, wear and distortion of the pin, or the loss thereof. If the locking pin is inserted incorrectly or fails, a patient's arm could be injured if strapped to the rail. In addition, the forcing action of the rail's notched tube against the pin causes a pinch point where an attending nurse's fingers (as well as linen, I.V. tubes, etc.) could be caught while manipulating the rail.

SUMMARY OF THE INVENTION

An object of the present invention is to provide a rail assembly having as many concealed moving parts as possible.

Another object of the invention is to eliminate all possible pinch points associated with a hinged rail assembly.

A still further object of the invention is to provide a fail-safe locking mechanism while obtaining optimum rigidity and strength in a rail assembly locked in any of a plurality of positions.

In accordance with the above and other objects, a multiple-position, hinging armboard rail assembly is provided. The assembly includes a pair of hinge pins inserted into opposite ends thereof. A locking tab mechanism is provided at one end of the stretcher, preferably the foot end. A spring-loaded locking mechanism is permanently secured to the rail assembly. The mechanism is self-locking and returns unassisted to the locking position after the rail assembly is indexed. In a preferred embodiment of the invention, locking is accomplished by means of a square male plug which fits within a corresponding female plug positioned within a casting secured to the stretcher.

DETAILED DESCRIPTION OF THE INVENTION

Figure 1:
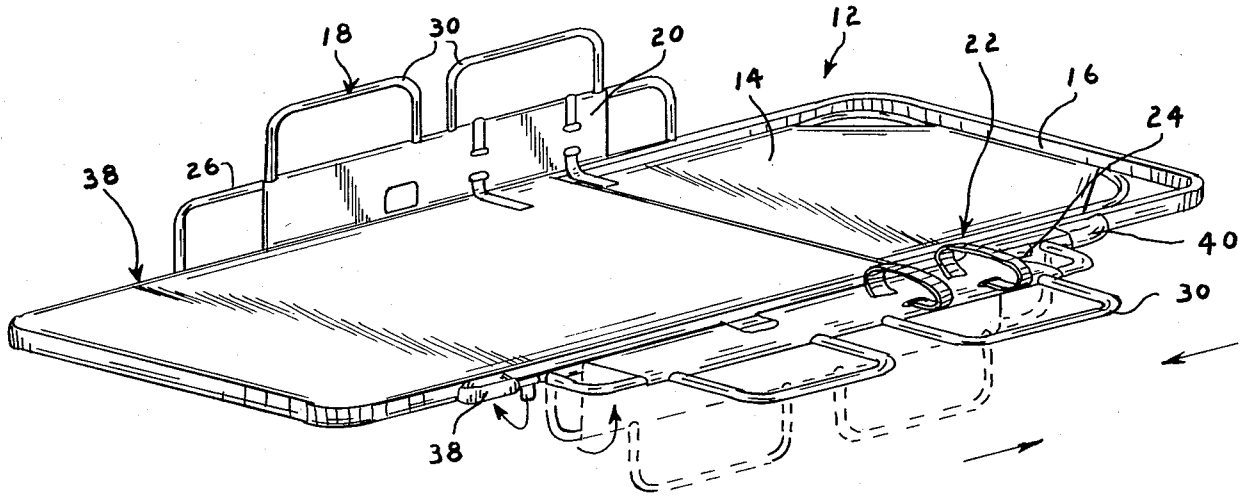
FIG. 1 is a perspective view of a portion of a wheeled stretcher in accordance with the invention.
Figure 3:
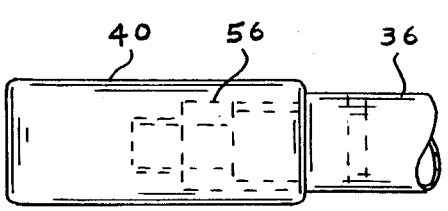
FIG. 3 is an enlarged side elevation view of the opposite end of the rail assembly thereof.
Figure 2:
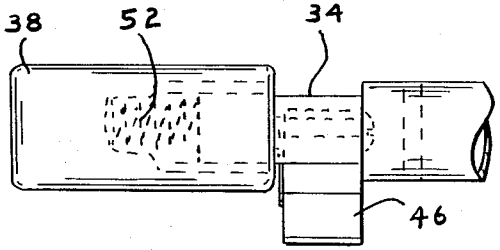
FIG. 2 is an enlarged side elevation view of one end of the rail assembly thereof.
Figure 4:
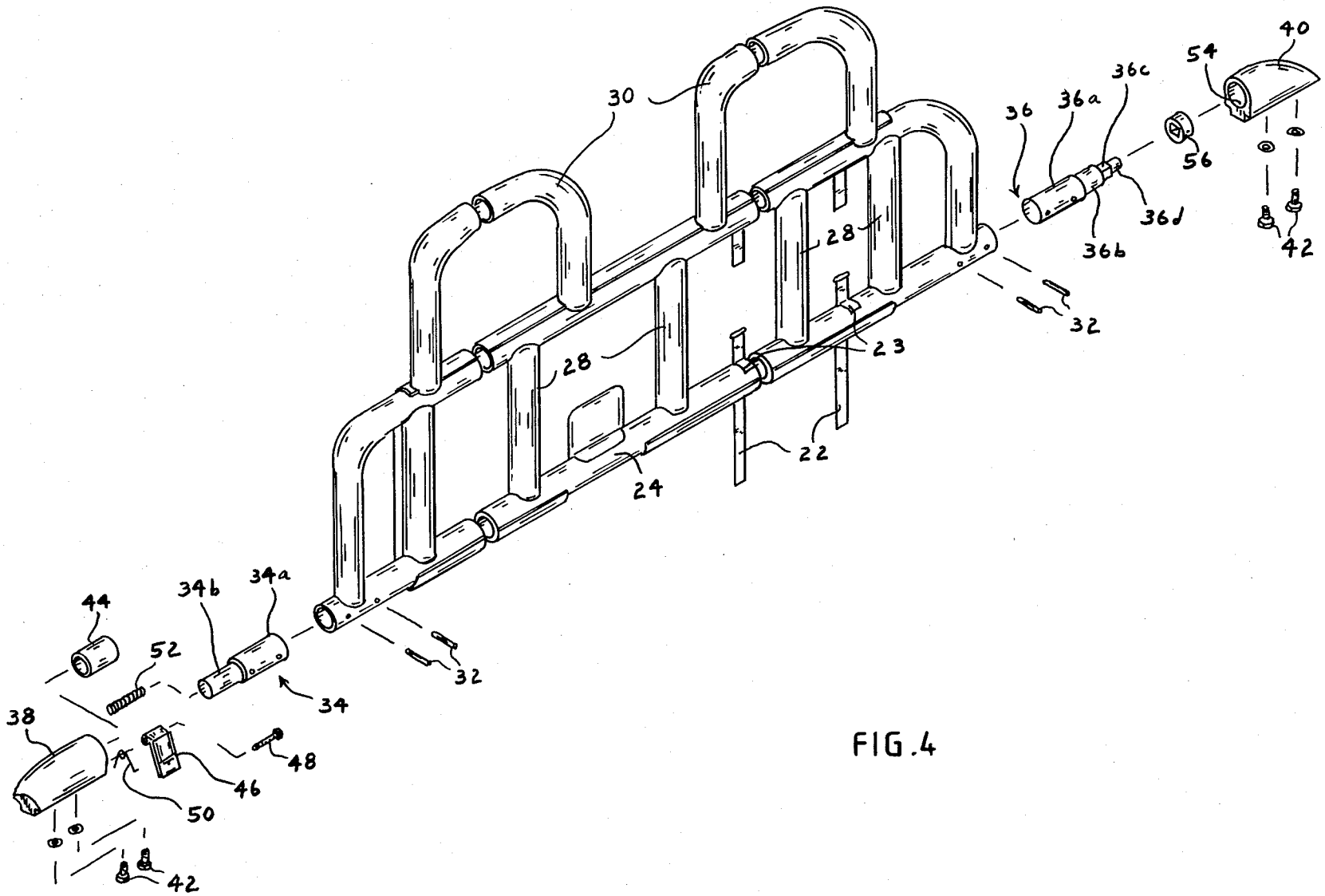
FIG. 4 is an exploded perspective view of the rail assembly.

A rail assembly for a wheeled stretcher 12 or the like is provided. The top portion of such a stretcher is shown in FIG. 1. The mechanism supporting this portion may resemble that shown in U.S. Pat. No. 3,304,116 or any other structure well known to those skilled in the art.

The wheeled stretcher 12 includes a support surface 14 secured to a channel frame 16. A pair of armboard rail assemblies 18 are secured to the frame and pivotable with respect thereto. Covers 20 are attached to the rails by means of self-clinching means. Each of the covers includes several elongate openings through which restraining straps 22 are inserted. The straps may include surfaces having hook and loop type fastening means (not shown) which allow the ends thereof to be secured to each other. Pop rivets 23 are used to attach the straps to the rail assemblies.

The rail assemblies 18 each include a hinging support tube 24, an armboard rail 26, spacer tubes 28 extending between the support tube 24 and armboard rail 26, and a top rail 30 secured to the armboard rail 26. The covers 20 are secured to the support tubes 24 and armboard rails 26. With the covers so attached and the restraining straps 22 in proper position, the wheeled stretcher can be employed as a minor surgery suture board when the rail assembly 10 is horizontally disposed. When vertical, the patient is shielded by the rail assemblies and covers.

Each end of the support tube 24 includes a hinge pin permanently secured therein by a pair of spring pins 32. The hinge pin 34 positioned within the foot end includes a first cylindrical portion 34*a* having a pair of holes therein for receiving the spring pins and a second cylindrical portion 34*b* of smaller diameter extending therefrom. The hinge pin 36 at the opposite end is defined by a first cylindrical portion 36*a*, a second cylindrical portion 36*b* of smaller diameter extending therefrom, a square portion 36*c*, and a third cylindrical portion 36*d* of still smaller diameter extending from the square portion.

A pair of castings 38, 40 are bolted to the stretcher at the bumper channels of the stretcher. Bolts 42 are provided for this purpose. The foot end casting 38 includes a cylindrical bore within which a nylon bearing 44 is permanently inserted. A locking tab 46 is secured to the casting by a screw 48. A torsion spring 50 is provided for automatically returning the tab to the locked position. The rail assembly is resiliently urged towards the head end of the stretcher by a compression spring 52.

The casting 40 at the head end includes a cylindrical bore having a groove 54 defined therein. The castings are positioned such that the support tube is capable of limited axial movement as the hinge pins move within the opposing bores. An insert 56 having an outer configuration corresponding to that of the bore and groove is permanently pressed in the casting. The insert 56 includes a square hole extending therethrough having dimensions corresponding to those of the square portion 36c of hinge pin 36. The insert is positioned such that the rail assembly can assume up vertical, horizontal, and down vertical positions.

In operation, the rail assembly is maintained in one of its three positions as the square portion of the head end hinge pin is positioned within the square hole of insert 56. The locking tab 46, under the urging of the torsion spring 50, maintains the assembly in an axially locked position. By pushing the locking tab downward with one hand while holding the rail assembly with the other hand, an attendant may slide the entire rail assembly 18 towards the foot end of the wheeled stretcher. This motion disengages the male hinge portion 36c from the head end insert 56 and allows easy indexing. The locking tab may be released as the assembly is lowered or lifted to the desired position. It will automatically relock due to the urging of the compression spring 52 which causes the square hinge pin portion 36c to be reinserted within insert 56. The locking tab 46 will automatically return to the locked position under the force exerted by the torsion spring 50.

The rail assembly is constructed such that when in the released position towards the foot end of the wheeled stretcher, it rotates on the symmetrical hinge pin 34 and bearing 44 in one casting 38 and the short, symmetrical end 36d of the hinge pin 36 and the insert 56 in the other casting 40. This positioning allows a free and smooth rotating action. Each hinge pin includes a cylindrical portion of sufficient length extending outside the support tube 24 such that the support tube and castings will not abut. By insuring these members are never closer than one half inch to each other, two possible pinch points are eliminated.

What is claimed is:

1. A rail assembly comprising:

an elongate member having a first end and a second end;

first and second opposing support means, each of said support means including an opening for pivotably supporting said first and second ends of said elongate member, respectively, said elongate member being movable within said respective openings along its longitudinal axis;

means for resiliently urging said elongate member towards said first support means;

said first end of said elongate member including a hinge pin extending within said opening within said first support means, said hinge pin including at least one cylindrical portion and at least one non-cylindrical portion;

said first support means including non-cylindrical walls defining at least a portion of said opening therein, said hinge pin being pivotable within said opening within said first support means when in a first axial position with respect thereto and being restrained from pivotable movement when said non-cylindrical portion of said pin is within said non-cylindrical walls defining said opening within said first support means;

a protective rail secured to said elongate member; and means for preventing axial movement of said elongate member along its longitudinal axis.

2. An assembly as defined in claim 1 wherein said non-cylindrical portion of said hinge pin is square, said non-cylindrical walls within said first support means defining a corresponding square opening.

3. An assembly as defined in claim 1 wherein said second end of said elongate member include a hinge pin extending within said opening within said second support means, said means resiliently urging said elongate member towards said first support member being a compression spring positioned within said second support means and bearing against said hinge pin within said second support means.

4. An assembly as defined in claim 1 wherein said cylindrical portion of said hinge pin extends axially beyond said non-cylindrical portion.

5. An assembly as defined in claim 1 wherein said hinge pin includes a first cylindrical portion, a second cylindrical portion coaxial with and extending from said first cylindrical portion, said second cylindrical portion having a smaller diameter than said first cylindrical portion, said non-cylindrical portion being coaxial with and extending from said cylindrical portion, and a third cylindrical portion coaxial with and extending from said non-cylindrical portion.

* * * * *